United States Patent [19]

Saito

[11] Patent Number: 4,520,880

[45] Date of Patent: Jun. 4, 1985

[54] AUTOMATIC STONE CUTTER

[76] Inventor: Yoshitaka Saito, 13 2-chome, Yamato-cho, Kasuga-shi, Fukukoa, Japan

[21] Appl. No.: 501,249

[22] Filed: Jun. 6, 1983

[51] Int. Cl.[3] ..... E21C 41/12

[52] U.S. Cl. ..... 175/51; 299/15

[58] Field of Search ..... 299/15; 175/51, 220; 173/45, 19

[56] References Cited

U.S. PATENT DOCUMENTS

| | | | |
|---|---|---|---|
| 561,367 | 6/1896 | Badger | 125/1 |
| 1,012,569 | 12/1911 | Mowlds | 299/15 |
| 1,482,396 | 2/1924 | Hansen | 173/45 |
| 2,341,322 | 2/1944 | Hubbell | 173/45 |
| 3,307,637 | 3/1967 | Jonsson | 173/19 |
| 3,570,563 | 3/1971 | Hall | 299/15 |
| 3,655,243 | 4/1972 | Fletcher | 299/15 |

FOREIGN PATENT DOCUMENTS

| | | | |
|---|---|---|---|
| 1375448 | 11/1964 | France | 299/15 |
| 575551 | 4/1958 | Italy | 125/1 |

*Primary Examiner*—William F. Pate, III

*Attorney, Agent, or Firm*—Brisebois & Kruger

[57] ABSTRACT

This invention relates to an automatic stone cutter having a construction in which a base can slide on right and left rails, a cylinder main body having a drill is mounted to the base so as to be capable of elevating in the longitudinal direction and the base moves on the rails in the interlocking arrangement with elevation of the cylinder main body. Moreover, the drill can always bore a hole in a predetermined depth from the surface of a mass of stone even if unevenness exists on the surface of the mass of stone.

2 Claims, 6 Drawing Figures

AUTOMATIC STONE CUTTER

BACKGROUND OF THE INVENTION

This invention relates to an automatic stone cutter. In dividing a mass of stone into pieces of stones having a predetermined shape after cutting out a rough or ore stone, it has been a customary practice to drive cutting tools on the basis of a wedge principle into the mass of stone with a predetermined gap between them but the cutting tools must be held manually until boring of each driving hole is completed. Hence, the work is troublesome and has low efficiency.

SUMMARY OF THE INVENTION

To obviate these problems, the present invention is directed to provide an automatic stone cutter having a construction in which a base is fitted slidably on right and left rails that are placed on the mass of stone, a cylinder main body is mounted to the base so as to be capable of elevating in the longitudinal direction, and a drill fitted to the cylinder main body bores automatically holes on the mass of stone in a predetermined boring depth. Moreover, when the drill is pulled out from the mass of stone after boring, the base moves automatically on the rails to the next boring position so that holes for dividing the mass of stone can be automatically bored without any manual intervention.

DESCRIPTION OF THE PREFERRED EMBODIMENTS

Figure 1:
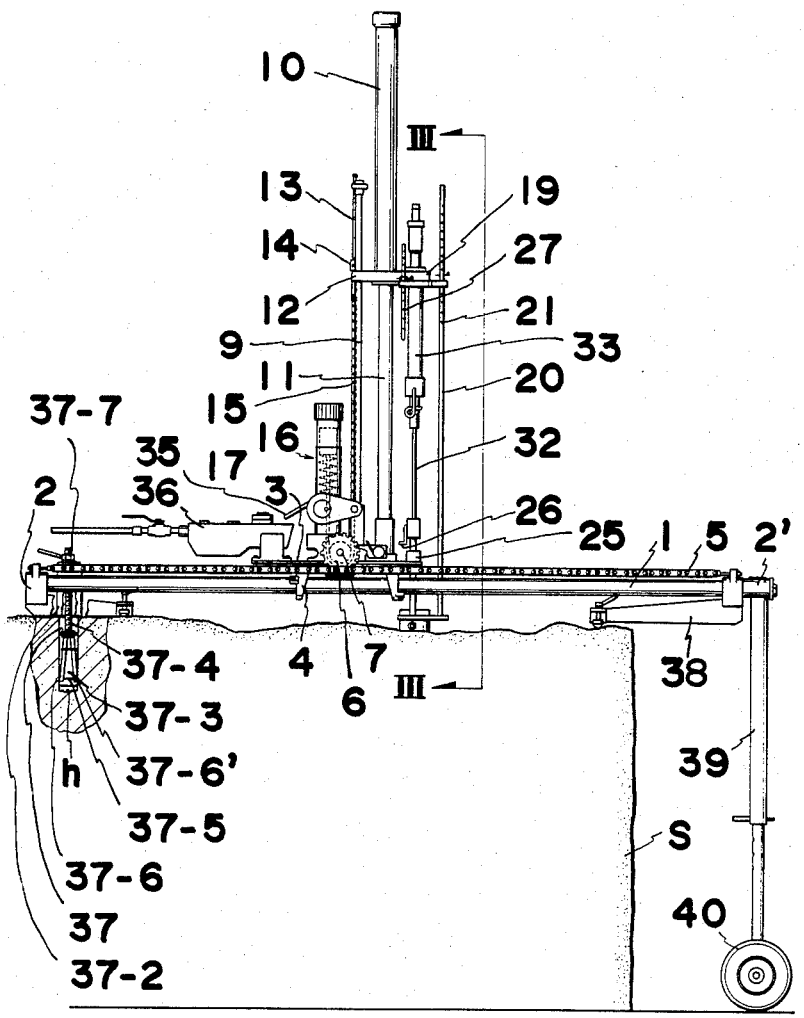
FIG. 1 is a side view of the automatic stone cutter in accordance with the present invention.
Figure 2:
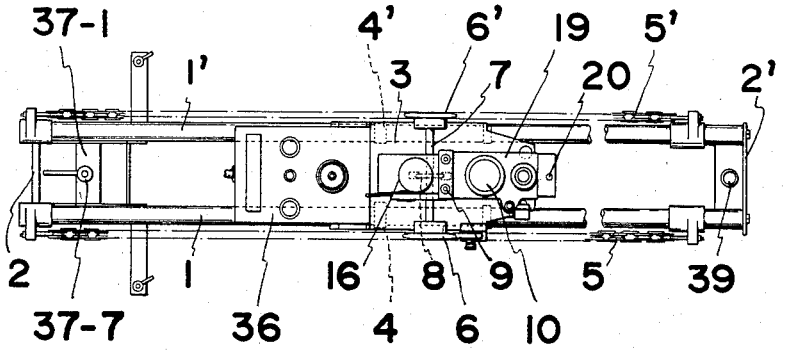
FIG. 2 is a plan view of the stone cutter.
Figure 4:
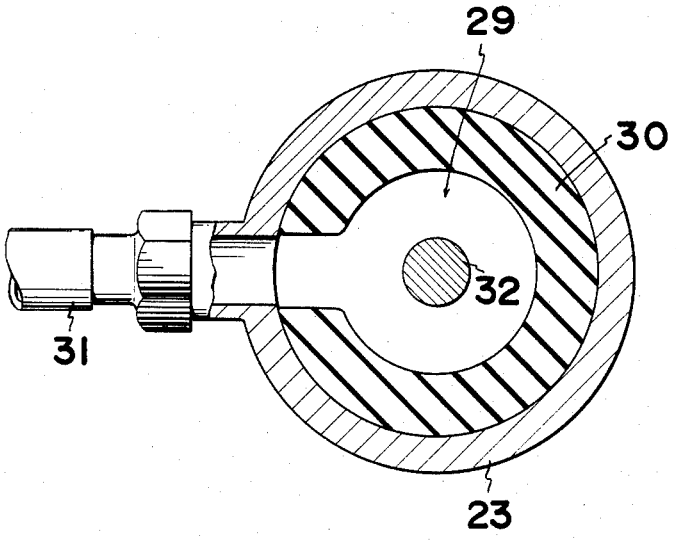
FIG. 4 is an enlarged sectional view taken along line IV—IV of FIG. 3.
Figure 3:
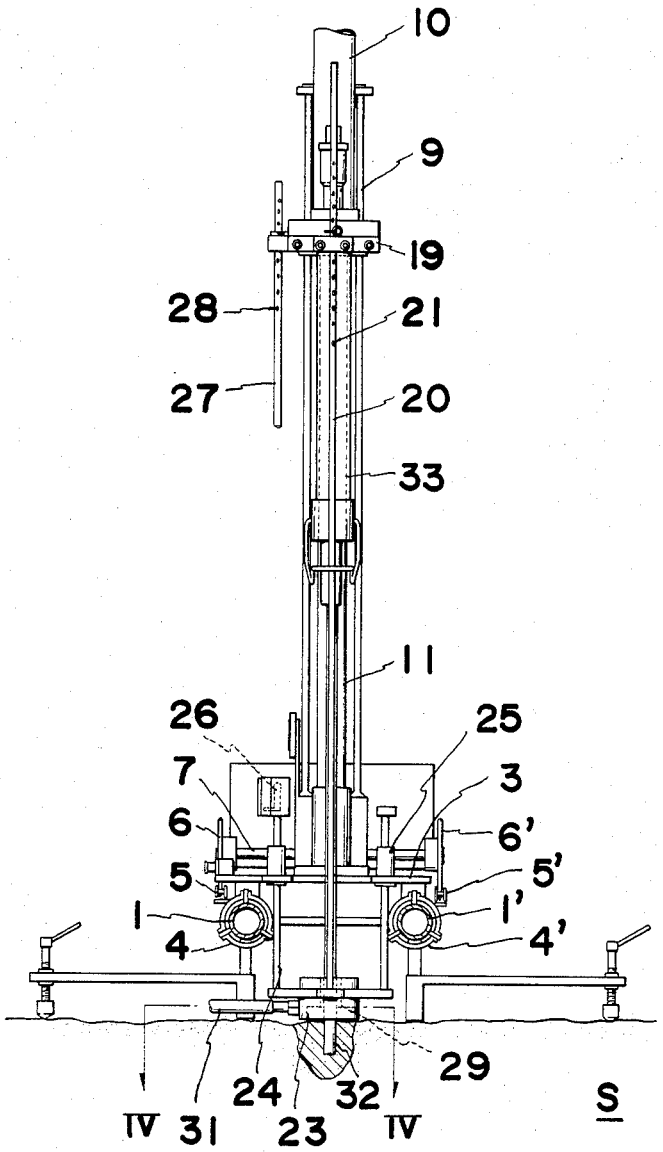
FIG. 3 is a sectional view taken along line III—III of FIG. 1.
Figure 5:
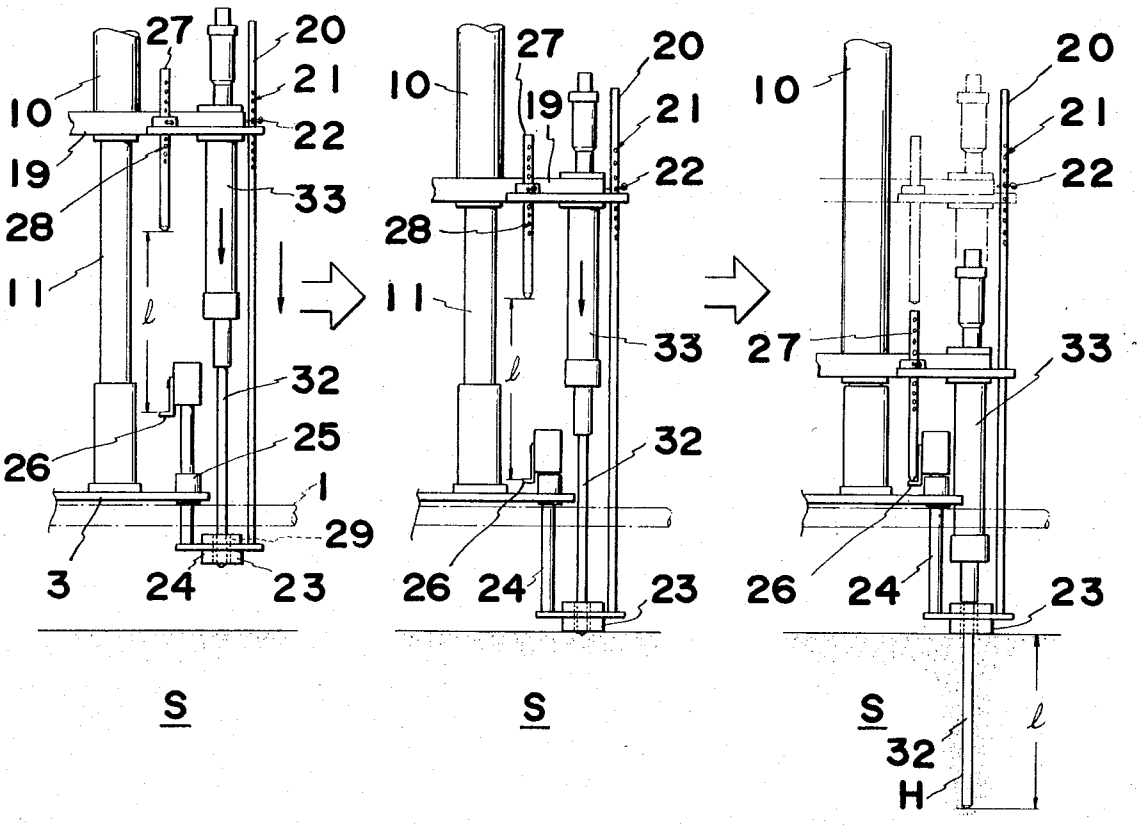
FIG. 5 is a schematic view showing the operating state of the stone cutter.
Figure 6:
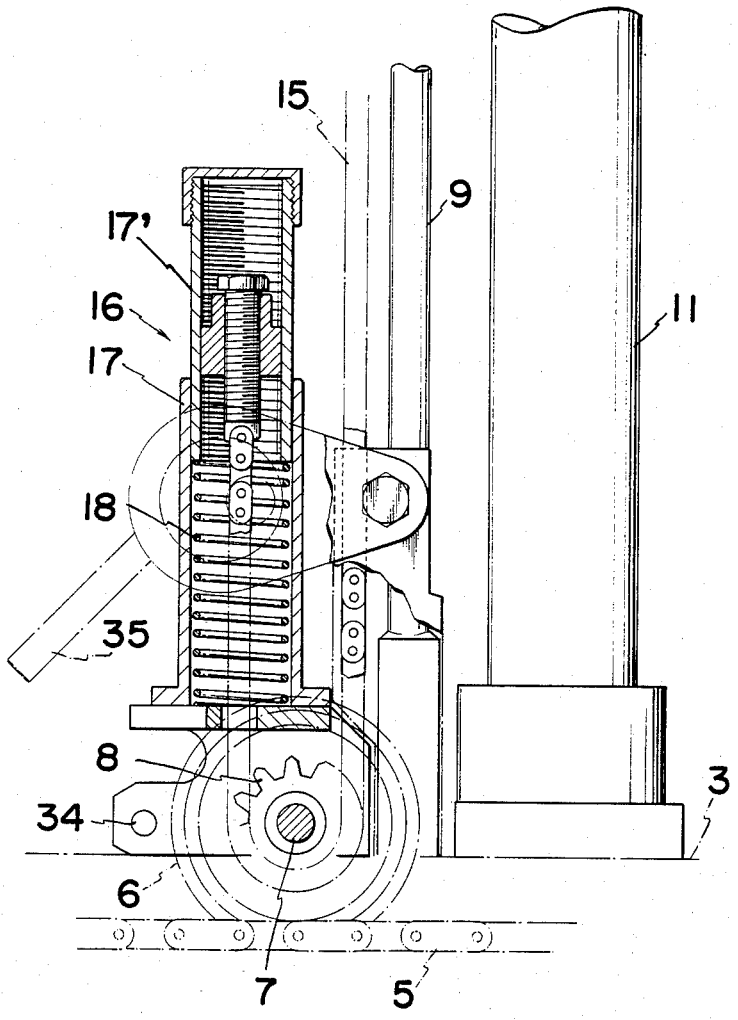
FIG. 6 is an enlarged sectional view of the principal portions of the stone cutter.

Hereinafter, the preferred embodiment of the present invention will be described in detail with reference to the accompanying drawings. In the drawings, reference numerals 1 and 1' represent right and left rails that are to be placed and fixed onto a mass of stone S (which will hereinafter be called simply the "stone") in parallel with each other. Each rail has a pipe-like shape and its forward and rear ends are fixed by fixing metals 2, 2'.

A bed 3 is disposed on the right and left rails 1, 1' in such a manner as to be slidable back and forth. Guides 4, 4' are disposed on the bottom of the base 3 at its right and left and are loosely fitted to the right and left rails 1, 1'. Right and left chains 5, 5' are stretched outside the right and left rails 1, 1' and engage with right and left sprockets 6, 6' pivotally supported on the right and left of the base 3.

Reference numeral 7 represents a sprocket shaft for the right and left sprockets 6, 6' and a center sprocket 8 is disposed at the center of this shaft 7 in such a manner as to rotate together with the sprocket shaft 7 only in a predetermined direction but to be idle in the opposite direction.

Reference numeral 9 represents a support implanted onto the base 3. A cylinder main body 10 is disposed in front of the support 9 so as to be able to move up and down in the vertical direction, and is actuated either by oil pressure or by air pressure. A piston rod 11 is disposed below the cylinder main body 10 and the lower end of this piston rod 11 is implanted and fixed to the base 3.

Reference numeral 12 represents a butt metal that projects from the cylinder main body 10, and reference numeral 13 represents an elevating rod supported by the support 9 so as to be able to elevate. An anchor projection 14 is disposed at the intermediate part of the elevating rod 13.

One end of a center chain 15 is connected to the lower end of the elevating rod 13 and the center chain 15 engages with the center sprocket 8 from below the same. The other end of the center chain is connected to an actuator 16.

The actuator 16 is mounted to the base 3 and includes a cylinder 17 in which a spring 18 is incorporated. The spring 18 urges upward an inner cylinder 17' fitted into the cylinder 17 and the other end of the center chain 15 is connected to the lower end of this inner cylinder 17'.

A bracket 19 is also fitted to the cylinder main body 10 and an adjusting rod 20 is slidably inserted through the bracket 19. A large number of adjusting holes 21 are bored in the transverse direction on the circumferential wall of the adjusting rod 20. A pin 22 is inserted into one of these holes 21 and is anchored to the upper surface of the bracket 19 so that the adjusting rod 20 is suspended from the bracket 19 via the pin 22. One end of a stone contact member 23 is connected to the lower end of the adjusting rod 20 and a guide rod 24 is implanted to the other end of this contact member 23 and is inserted through and supported by a guide sleeve 25 of the base 3.

A sensor 26 that projects from the guide sleeve 25 is disposed at the upper end of the guide rod 24 and a sensor operation rod 27 is suspended from the bracket 19 above the sensor 26 with a predetermined distance l between them. The sensor operation rod 27 is suspended in such a manner that its vertical position can be freely adjusted. Reference numeral 28 represents adjusting holes.

The sensor 26 is connected to a limit switch so as to stop lowering of the cylinder main body 10 and to change over it to the rising operation.

A hole 29 for inserting an excavation rod is bored at the center of the stone contact member 23 and a horseshoeshaped dust-proofing rubber 30 is disposed inside the contact member 23. The open portion of this rubber is communicated with a suction pipe 31 that is disposed around and inside the contact member 23 so as to suck the dust in boring the mass of stone.

In the drawings, reference numeral 32 represents a drill connected to the cylinder main body 10 and a rotation mechanism 33 for rotating the drill is fitted to the upper end of the drill. Small longitudinal holes are bored in the stone S by this drill 32.

Reference numeral 34 represents a cylindrical pivot portion for releasing the engagement between the center chain 15 and the center sprocket 8 and for inclining the cylinder 17. Reference numeral 35 represents a level for inclining the cylinder 17.

Reference numeral 36 represents an oil or air pressure control mechanism and 37 is a fixing mechanism for fixing the right and left rails 1, 1' to the stone S. Reference numeral 37-1 is a support plate; 37-2 is a conical rod; 37-3 is a spacer; 37-4 is an upper screw rod; 37-5 is a taper portion; 37-6 and 37-6' are expanding member; and 37-7 is an operation screw. Symbol h represents a fixing hole on the stone S.

Reference numerals 38 and 38' represent auxiliary fixing members that are disposed below one end each of the right and left rails 1, 1'. A retractile wheel support rod 39 is connected to the end portions of the right and left rails 1, 1' where the auxiliary fixing members 38, 38' are disposed. A transporting wheel 40 is disposed at the lower end.

The operation of the apparatus of the present invention having the construction described above will be now described.

First, the positions where dividing is to be made, is determined on the surface of the stone S and the fixing holes h are then bored at the positions in the proximity of the front and rear ends of the right and left rails 1, 1' in order to fix the rails at the dividing positions. The end portions of the right and left rails are fixed by the fixing mechanism 37 using these fixing holes h. Next, the cylinder main body 10 is actuated for descension by the oil or air pressure. In this case, the adjusting rod 20, the stone contact member 23, the guide rod 24, the sensor 26 and the like lower integrally with the cylinder main body 10 and at the point when the contact member 23 comes into contact with and stops on the upper surface of the stone S, the sensor 26 also stops lowering but only the cylinder main body 10 keeps lowering together with the sensor operation rod 27. Boring is thus effected while the drill 32 is put onto the stone S. After boring is made in the distance l, the sensor operation rod 27 which is integral with the cylinder main body 10 comes into contact with the sensor 26, whereupon the limit switch is actuated and the cylinder main body 10 stops lowering but starts elevation, thereby completing boring of the hole in the predetermined distance. In this manner, as the stone contact member 23 comes into contact with the stone S, the drill 32 bores the stone S in the predetermined boring depth, that is, the distance l between the sensor operation rod 27 and the sensor 26. Accordingly, boring of a predetermined depth can be always made from the surface of the stone irrespective of the unevenness on the surface of the stone S.

During the boring operation of the drill 32, the cylinder main body 10 keeps lowering and during the lowering operation of the latter, the elevating rod 13 also keeps lowering so that the center chain 15 connected to the lower end of the elevating rod is stretched and actuated by the actuator 16. In this instance, the center sprocket 8 engaging with the center chain 15 rotates due to the stretching operation of the chain but its rotation is not transmitted to the sprocket shaft 7, thereby establishing the idle state. Hence, the right and left sprockets 6, 6' do not rotate at all and the base 3 remains stationary on the right and left rails 1, 1'.

On the other hand, a distance exists from the lower end to a predetermined position between the butt metal 12 of the cylinder main body and the elevating rod 13 so that the cylinder main body 10 reaches the predetermined position when it shifts to the elevating operation. Accordingly, when the cylinder main body 10 moves up and reaches this position, the butt metal 12 comes into contact with the lower surface of the anchor projection 14. At this position of the cylinder main body 10, the drill 32 is completely pulled out from the bored hole H. As the cylinder main body 10 further elevates, the butt metal 12 pushes up the anchor projection 14 to elevate the elevating rod 13 and along therewith, the center chain 15 disposed at the lower end rotates upward against the force of the actuator 16 and the center sprocket 8 engaging with the center chain as well as the right and left sprockets 6, 6' also rotate. In consequence, the base 3 is slid on the right and left rails 1, 1' by the right and left chains 5, 5' till the base 3 reaches the position where the hole H is to be bored next. As this operation is repeated, a large number of holes H are bored with predetermined gaps between them along line determining the dimension. At the subsequent step, the stone is cut off by a cutting machine using the holes to divide the stone S into predetermined sizes along the dividing lines.

Incidentally, the dust generated during boring by the drill 32 is sucked by the suction pipe 31.

As the adjusting rod 20 is vertically adjusted, the elevating position of the stone contact member 23 elevating together with the cylinder main body 10 is adjusted so that the contact member 23 does not come into contact with the most projecting surface of the stone S during sliding movement of the base 3 back and forth.

According to the present invention, the base moves automatically while sliding on the rails once the rails are placed and fixed to the mass of stone and a large number of holes are bored along the dividing lines so that stone cutting can be automatically carried out while eliminating the necessity of manual work with the prior art method. Hence, the present invention can drastically save the labor. Furthermore, the drilling depth of the stone can be set in advance by the stone contact member in cooperation with the sensor and the sensor operation rod and boring can be uniform irrespective of the unevenness of the surface of the mass of stone.

What is claimed is:

1. An automatic stone cutter comprising:

a base, a support including elongated rail means supporting said base for movement along a predetermined path along a stone to be cut, a drill for forming a hole in the stone, a cylinder mounted on said base for movement generally perpendicularly to said rail means and toward and away from the stone, means mounting said drill on said cylinder means for movement with the cylinder means toward and away from the stone, a sprocket shaft rotatably supported on said base, a sprocket on said shaft, means on said support engaging said sprocket for moving said base along the rail means in response to rotation of the sprocket, a rod having a stone contact member at one end for contacting a surface of the stone to cut, mounting means for mounting said rod on a bracket connected to said cylinder for movement with the cylinder between a first position in which the contact member engages the surface of the stone to be cut, and a second position in which the contact member is spaced from the surface of the stone, said mounting means comprising a lost motion connection between the bracket and the rod for permitting the cylinder and drill to continue to move toward the stone after the contact member engages the stone, means for adjusting the longitudinal position of the rod relative to the bracket, a drilling depth sensor connected to said rod for movement with the rod, a sensor operating rod connected to the cylinder for movement with the cylinder and drill toward the stone, from a position in which the operating rod is spaced from the sensor, to a position in which the operating rod engages the sensor, so that the sensor operating rod engages the sensor to stop further movement of the cylinder when a hole of predetermined depth is formed.

2. An automatic stone cutter comprising:

a base, a support including elongated rail means supporting said base for movement along a predetermined path along a stone to be cut, a drill for forming a hole in the stone, a cylinder mounted on said base for movement generally perpendicularly to said rail means and toward and away from the stone, means mounting said drill on said cylinder means for movement with the cylinder means toward and away from the stone, a sprocket shaft rotatably supported on said base, a sprocket on said shaft, means on said support engaging said sprocket for moving said base along the rail means in response to rotation of the sprocket, a chain having a first end connected to said cylinder, a second sprocket on said sprocket shaft, a one-way drive between said second sprocket and said shaft for permitting said second sprocket to rotate relative to the shaft in one direction and to drive the shaft in the other direction, said chain extending around said second sprocket, and having a second end connected to tensioning means on the base for maintaining tension in the chain, said tensioning means pulling the chain to rotate the second sprocket in said one direction as said cylinder moves toward the stone, and said cylinder pulling said chain to rotate said second sprocket in said other direction to drive said sprocket shaft as said cylinder moves away from the stone, so that said base is driven along said rails during movement of the cylinder away from the stone.

* * * * *